United States Patent [19]

Kobayashi

[11] Patent Number: 4,771,746

[45] Date of Patent: Sep. 20, 1988

[54] FUEL SUPPLY CONTROL SYSTEM FOR AN ENGINE

[75] Inventor: Tomoya Kobayashi, Tokyo, Japan

[73] Assignee: Fuji Jukogyo Kabushiki Kaisha, Tokyo, Japan

[21] Appl. No.: 18,506

[22] Filed: Feb. 25, 1987

[30] Foreign Application Priority Data

Feb. 27, 1986 [JP] Japan ..... 61-43093

[51] Int. Cl.[4] ..... F01M 11/12

[52] U.S. Cl. ..... 123/196 S; 123/198 DB; 123/333

[58] Field of Search ..... 123/196 S, 198 DB, 198 D, 123/333

[56] References Cited

U.S. PATENT DOCUMENTS 4,102,316 7/1978 Valbert ..... 123/196 S X
4,404,939 9/1983 Kinzl et al. ..... 123/333
4,489,311 12/1984 Lang et al. ..... 123/196 S X
4,562,801 1/1986 Koike ..... 123/198 D X
4,685,431 8/1987 Kubota et al. ..... 123/196 S

FOREIGN PATENT DOCUMENTS 55-148970 11/1980 Japan ..... 123/198 D

*Primary Examiner*—Willis R. Wolfe
*Assistant Examiner*—Eric R. Carlberg
*Attorney, Agent, or Firm*—Martin A. Farber

[57] ABSTRACT

A fuel supply control system for an engine has an engine speed sensor for producing an engine speed signal, a sensor for sensing amount of lubricating oil in an oil pan of the engine and for producing an oil signal dependent on the amount of the oil. In response to the engine speed signal and oil signal, fuel supply is cut off when the engine speed exceeds a predetermined engine speed above which bouncing of intake and exhaust valves of the engine occurs.

11 Claims, 3 Drawing Sheets

FUEL SUPPLY CONTROL SYSTEM FOR AN ENGINE

BACKGROUND OF THE INVENTION

The present invention relates to a fuel supply control system for an engine for motor vehicles.

A system in which the amount of fuel supplied to an engine is calculated based on amount of induced air, speed of engine, and other factors is known.

On the other hand, when the engine speed exceeds a predetermined value, intake and exhaust valves of the engine begin to bounce, which will cause misfiring and/or breakdown of the engine. in order to prevent such disadvantages, a fuel control system has a fuel cutoff system which operates when the engine speed exceeds a predetermined value which is slightly lower than the bounce beginning speed. However, in an automotive engine having a valve system provided with a hydraulic lash adjuster, the bounce beginning speed varies in accordance with the amount of lubricating oil. Especially, when the amount of oil in an oil pan is reduced, bubbles caused by blowing gas enter into the oil for lubricating the valve system, which will cause malfunction of the valve system and lowers the bounce beginning speed.

Namely, in the conventional system, when the amount of oil reduces, the bouncing occurs before the fuel is cut off. In other words, the conventional system cannot prevent the bouncing when the amount of oil reduces.

SUMMARY OF THE INVENTION

The object of the present invention is to provide a system which may prevent the bouncing of valves, even if the amount of oil reduces.

In the system of the invention, fuel cutoff is performed at an engine speed dependent on the amount of oil.

According to the present invention, there is provided a fuel supply control system for an engine having fuel supply means, and intake and exhaust valves, comprising: means for producing an engine speed signal dependent on speed of the engine, sensing means sensing amount of lubricating oil in the engine, for producing an oil signal dependent on the amount of the oil, means responsive to the engine speed signal and oil signal for producing a fuel cutoff signal when the engine speed exceeds a predetermined engine speed, dependent on the amount of oil, above which bouncing of the intake and exhaust valves of the engine occurs, and means responsive to the fuel cutoff signal for cutting off fuel supply by the fuel supply means.

In an aspect of the invention, the sensing means is a sensor for sensing the amount of lubricating oil in an oil pan of the engine, and the predetermined engine speed for producing the fuel cutoff signal decreases with a decrease of the amount of the lubricating oil.

The other objects and features of this invention will become understood from the following description with reference to the accompanying drawings.

DETAILED DESCRIPTION OF THE PREFERRED EMBODIMENT

Figure 1:
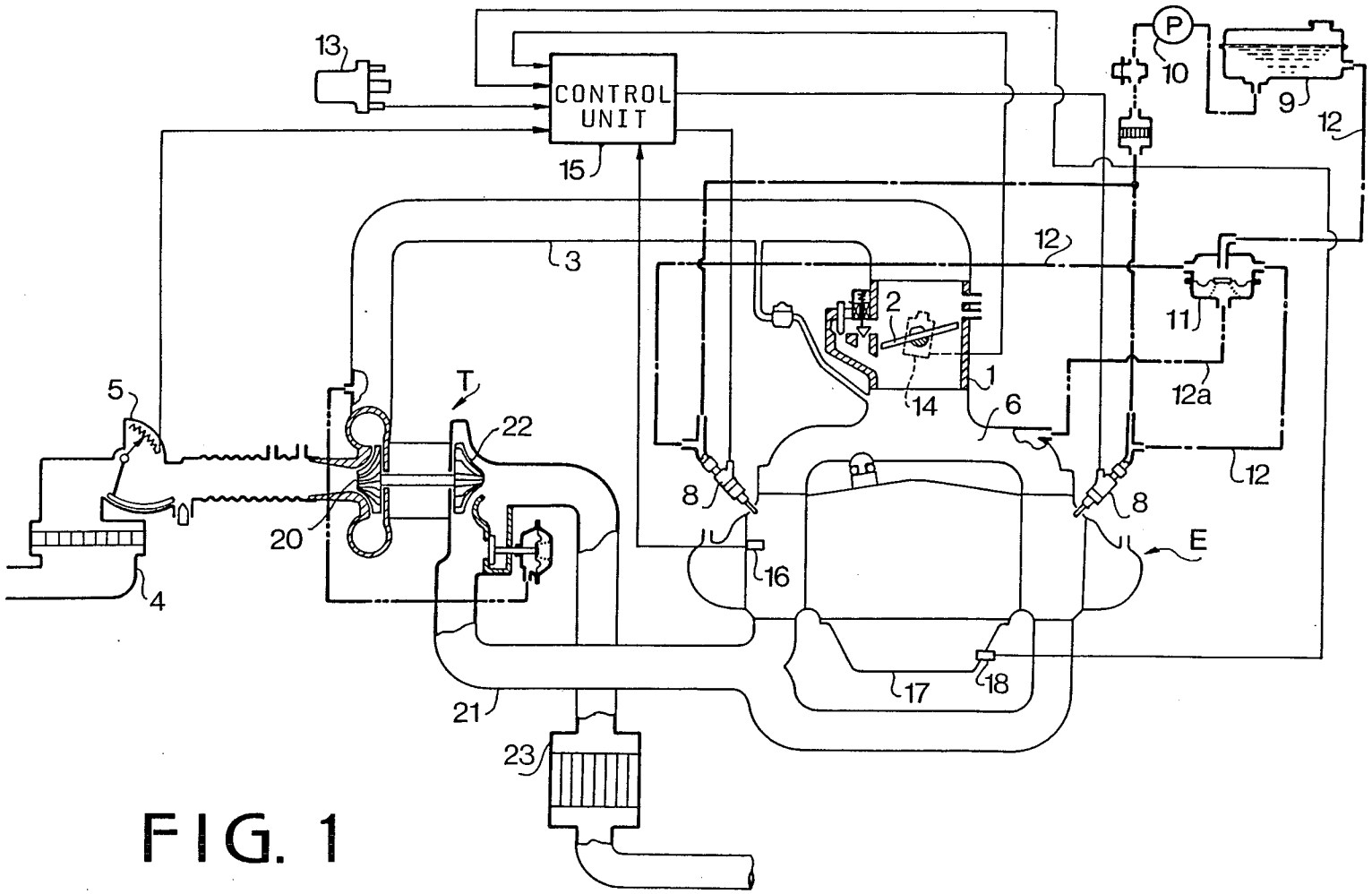
FIG. 1 is a schematic diagram showing a system of the present invention.

Referring to FIG. 1, an engine E has a throttle body 1 having a throttle valve 2 communicated with an intake pipe 3. In the intake system, an air cleaner 4, air flow meter 5, and compressor 20 of a turbocharger T are provided. In an exhaust pipe 21, an exhaust gas turbine 22 and a catalytic converter 23 are provided. Fuel is supplied to fuel injectors 8 from a fuel tank 9 by a fuel pump 10, and returned to the tank 9 through a passage 12 and a pressure regulator 11 which is opened by intake manifold vacuum applied through a pipe 12*a*.

The engine E is provided with a throttle position sensor 14, coolant temperature sensor 16, and oil amount sensor 18 provided in an oil pan 17 for detecting the amount of lubricating oil in the oil pan. Output signals of the sensors 14, 16 and 18 are applied to a control unit 15. The control unit 15 is further applied with a signal from the air flow meter 5 and with a signal from an ignition coil 13.

Figure 2:
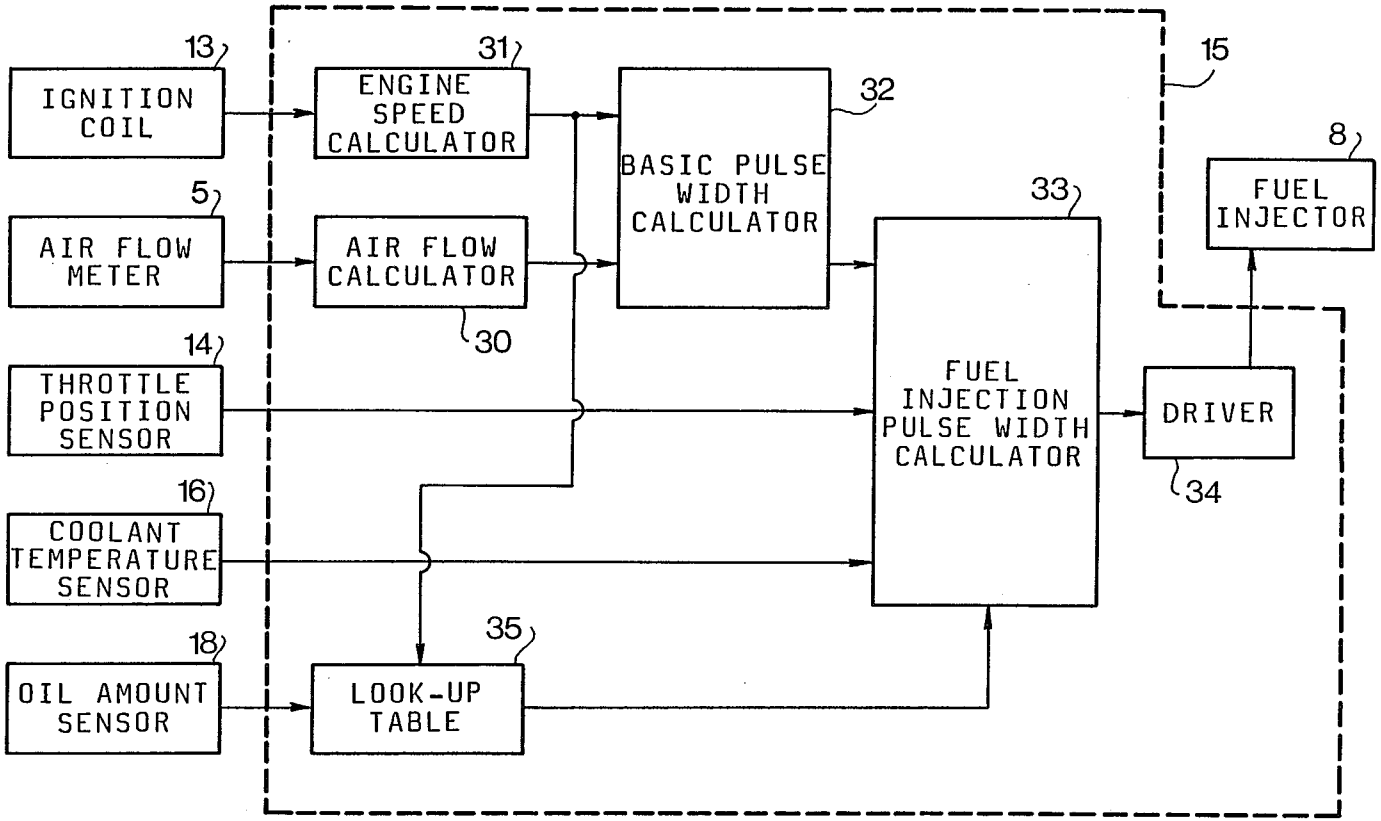
FIG. 2 is a block diagram of a control system of the present invention.
Figure 3:
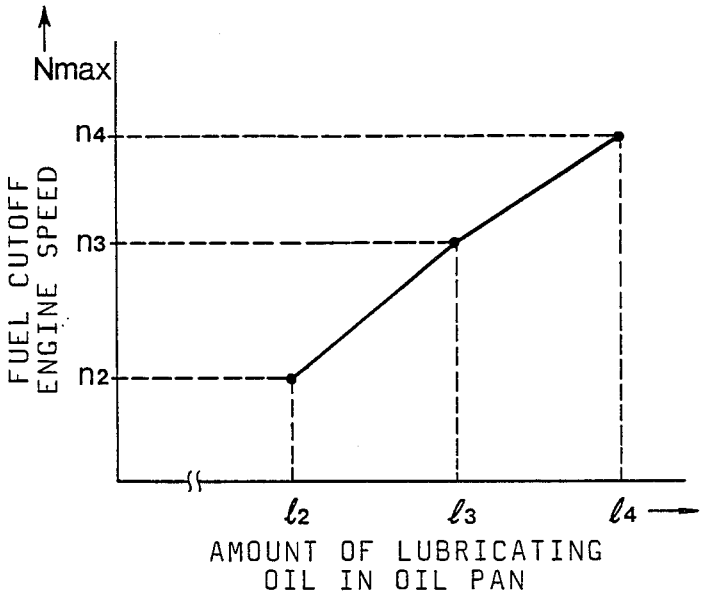
FIG. 3 is a graph showing the relationship between amount of oil and engine speed for cutting off fuel.
Figure 4:
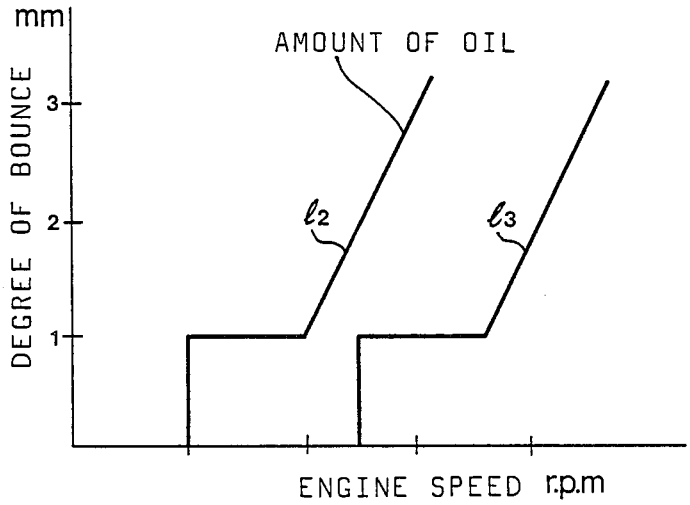
FIG. 4 is a graph showing the relationship between engine speed and degree of bounce with respect to amount of oil.

Referring to FIG. 2, the output signal of the ignition coil 13 is fed to an engine speed calculator 31 which produce an output signal dependent on engine speed, and the output signal of the air flow meter 5 is fed to an air flow calculator 30. Output signals of both calculators 31 and 30 are fed to a basic pulse width calculator 32, the output signal of which is applied to a fuel injection pulse width calculator 33. Output signals of throttle position sensor 14 and coolant temperature sensor 16 are also applied to the calculator 33. The output signal of the oil amount sensor 18 and the output signal of the engine speed calculator 31 are fed to a look-up table 35 for producing a fuel cutoff engine speed. The look-up table 35 stores data of maximum engine speeds with respect to amount of oil and produces a signal for cutting off the fuel supply. FIG. 3 shows an example of data, in which the maximum engine speed increases from n2 to n4 with an increase of the amount of oil in the oil pan 17 from l2 to l4. Each maximum engine speed is determined to be a value slightly lower than a value which causes the bounce of the valves. FIG. 4 shows a relationship between the degree of the bounce and engine speed with respect to the amount of oil. The fuel cutoff engine speed is determined to be a value which will cause bouncing larger than a predetermined value, for example 1 mm.

In operation, the calculator 32 produces a basic pulse width signal which is fed to the calculator 33. The calculator 33 corrects the basic pulse width in accordance with output signals of throttle position sensor 14 and coolant temperature sensor 16. The corrected fuel injection pulse width signal from the calculator 33 is applied to the fuel injectors 8 through a driver 34 to inject the fuel to operate the engine. When engine speed exceeds a predetermined fuel cutoff speed (maximum engine speed) dependent on the amount of oil in the oil pan 17, the look-up table 35 produces a fuel cutoff signal. In response to the fuel cutoff signal, the calculator 33 produces a signal which represents that the fuel injection pulse width is zero. Thus, the fuel injectors stop injecting. Accordingly, the bouncing of the valves can be prevented.

Although the above described system is provided with fuel injectors, the invention can be applied to an engine having a carburetor. Further, the look-up table 35 may be replaced with a calculator for producing a fuel cutoff signal in accordance with the calculation of the amount of oil and engine speed.

While the presently preferred embodiment of the present invention has been shown and described, it is to be understood that this disclosure is for the purpose of illustration and that various changes and modifications may be made without departing from the spirit and scope of the invention as set forth in the appended claims.

What is claimed is:

1. A fuel supply control system for an engine having fuel supply means, and intake and exhaust valves, the fuel supply means for supplying fuel to the engine through the intake valves of the engine, the control system comprising:

means for producing an engine speed signal dependent on speed of the engine;

sensing means for sensing amount of lubricating oil in the engine, for producing an oil signal dependent on the amount of the oil;

first means responsive to the oil signal for determining a maximum engine speed dependent on the amount of the oil, above which maximum engine speed bouncing of the intake and exhaust valves of the engine occurs;

said first means being responsive to the engine speed signal for producing a fuel cutoff signal when the engine speed exceeds the maximum engine speed; and second means responsive to the fuel cutoff signal for cutting off the supply of the fuel by the fuel supply means.

2. The fuel supply control system according to claim 1 wherein the sensing means is a sensor for sensing the amount of lubricating oil in an oil pan of the engine.

3. The fuel supply control system according to claim 1 wherein the maximum engine speed for producing the fuel cutoff signal decreases with decrease of the amount of the lubricating oil.

4. The fuel supply control system according to claim 1 wherein the first means comprises a look-up table storing data of maximum engine speeds for different amounts of the oil.

5. The fuel supply control system accoocrding to claim 1 wherein said bouncing is a bouncing larger than a predetermined value.

6. A fuel supply control system for an engine having fuel supply means, and intake and exhaust valves, the fuel supply means for supplying fuel to the engine through the intake valves of the engine, the control system comprising:

means for producing an engine speed signal dependent on speed of the engine;

sensing means for sensing amount of lubricating oil in the engine, for producing an oil signal dependent on the amount of oil;

first means responsive to the engine speed signal for determining a minimum amount of oil dependent on the engine speed below which minimum amount of oil bouncing of the intake and exhaust valves of the engine occurs;

said first means being responsive to the oil signal for producing a fuel cutoff signal when the amount of the oil is lower than minimum amount of oil; and second means responsive to the fuel cutoff signal for cutting off the supply of the fuel by the fuel supply means.

7. The fuel supply control system according to claim 6 wherein the first means comprises a look-up table storing data of maximum engine speeds for different amounts of oil.

8. The fuel supply control system according to claim 6 wherein said bouncing is a bouncing larger than a predetermined value.

9. A fuel supply control system for an engine having fuel supply means, and intake and exhaust valves, the fuel supply means for supplying fuel to the engine through the intake valves of the engine, the control system comprising:

means for producing an engine speed signal dependent on speed of the engine;

sensing means for sensing amount of lubricating oil in the engine, for producing an oil signal dependent on the amount of the oil;

first means responsive to said engine speed signal and said oil signal for providing a fuel cutoff signal as a variable function of both engine speed and amount of oil such that bouncing of the intake and exhaust valves is prevented; and second means responsive to the fuel cutoff signal for cutting off the supply of the fuel by the fuel supply means.

10. The fuel supply control system according to claim 9 wherein the first means comprises a look-up table storing data of maximum engine speeds for different amounts of oil.

11. The fuel supply control system according to claim 9 wherein said bouncing is a bouncing larger than a predetermined value.

* * * * *